US006450735B1

(12) United States Patent
Mills et al.

(10) Patent No.: US 6,450,735 B1
(45) Date of Patent: Sep. 17, 2002

(54) METHOD AND EQUIPMENT FOR VENTILATING UNDERGROUND WORKINGS

(75) Inventors: Peter Shelley Mills, Stamping Ground; Anthony Cecil Plaisted, Lexington; Michael Robert Amick, Georgetown, all of KY (US)

(73) Assignee: Fosroc International Limited, Swindon (GB)

( * ) Notice: Subject to any disclaimer, the term of this patent is extended or adjusted under 35 U.S.C. 154(b) by 367 days.

(21) Appl. No.: 08/960,576

(22) Filed: Oct. 29, 1997

(30) Foreign Application Priority Data

Oct. 31, 1996 (GB) ..... 9622675

(51) Int. Cl.[7] ..... E21F 1/14
(52) U.S. Cl. ..... 405/150.2; 405/303; 454/169
(58) Field of Search ..... 405/132, 150.2, 405/303; 454/168–170

(56) References Cited

U.S. PATENT DOCUMENTS

| | | | | |
|---|---|---|---|---|
| 3,302,343 A | | 2/1967 | Bear | 52/98 |
| 4,096,702 A | | 6/1978 | Burton | 405/132 |
| 4,315,657 A | | 2/1982 | Burton, III | 405/132 X |
| 4,398,451 A | | 8/1983 | Werthmann | 454/170 |
| 5,165,958 A | | 11/1992 | Plaisted et al. | 427/136 |
| 5,199,825 A | * | 4/1993 | Travis | 405/296 |
| 5,236,499 A | * | 8/1993 | Chervenak et al. | 106/612 |
| 5,330,785 A | * | 7/1994 | Plaisted et al. | 405/264 X |
| 5,472,297 A | * | 12/1995 | Heselden | 405/286 |

FOREIGN PATENT DOCUMENTS

| | | |
|---|---|---|
| AU | 6788287 | 8/1987 |
| FR | 2027532 | 10/1970 |
| WO | WO 85/04444 | 10/1985 |

OTHER PUBLICATIONS

Two page brochure relating to trademark Gridstop, 1997.
Detailed information relating to trademark Gridstop, 1997.

* cited by examiner

*Primary Examiner*—Thomas B. Will
*Assistant Examiner*—Tara L. Mayo
(74) *Attorney, Agent, or Firm*—Nixon & Vanderhye P.C.

(57) ABSTRACT

A method and kit for installing a stopping in a mine opening includes securely fixing in the mine opening a screen of a size of about 2 to 24 mesh, preferably about 10 to 20 mesh, most preferably about 12 to 16 mesh, and applying a mortar to the screen to form a coating on the screen; and continuing the application of the mortar until the stopping is airtight. Preferably the screen is composed of steel wire of a diameter from about 0.010 to 0.030 inches (about 0.025 to 0.075 cms). Preferably the mortar is ready-to-use-mortar. The kit comprises as a first component, a screen of mesh size of about 2 to 24 suitable for installation in an opening in the mine and receiving a mortar and supporting the mortar (having a tensile strength of at least 150 lbs/inch) and, as a second component, a mortar, preferably a ready-to-use mortar, for application to the screen to provide a stopping.

15 Claims, 2 Drawing Sheets

METHOD AND EQUIPMENT FOR VENTILATING UNDERGROUND WORKINGS

BACKGROUND AND SUMMARY OF THE INVENTION

This invention relates to a mine stopping, a method for its installation and to a kit of components for use in the method of installing the stopping.

Stoppings are walls or partitions which are constructed and positioned to direct fresh air into selected areas of the mine. Areas where there are personnel working are required to be properly ventilated. In order to achieve this the stoppings need to be impermeable to air.

Stoppings have been previously constructed from hollow concrete blocks either dry stacked or wet laid, i.e. cemented in place. The stoppings, are usually made airtight by applying a non-porous coating or layer to the surfaces and the various areas of abutment. The usual technique involves trowelling over the surface and abutment areas with cementitious mortars based on Portland cement/sand powder blends mixed with water.

The use of mortars, including those which are premixed with water and which are known in the art as ready-to-use mortars has been found to be limited by their inability to set under wet or high humidity conditions where drying cannot take place.

U.S Pat. No. 5,165,958 describes a solution to this problem and discloses a process for sealing mine stoppings in wet or humid conditions employing a ready-to-use mortar comprising first and second components, the first component comprising an alkali metal silicate solution and a non reactive filler and the second component being essentially a solution of a reactant for the alkali metal silicate.

The construction of mine stoppings from concrete blocks with subsequent application of mortar is time consuming and labor intensive. This problem is addressed in U.S. Pat. No. 4,096,702 which describes a mine stopping formed by employing a wire mesh and applying to the wire mesh a plaster or cement.

Further, Patent Application No. W085/04444 describes the formation of a mine stopping by spraying a cementitious material onto a steel mesh. The inventive step is to tension the mesh by means of steel cables in order to prevent sagging which can result in grout being dislodged from the mesh.

The installation of stoppings by these previously described methods is nevertheless time consuming and it is highly desirable to be able to reduce the installation time. It has been found by the present inventors that by the use of a critical size of mesh an effective stopping can be prepared by applying the mortar to the screen from one side only. At these critical mesh sizes the mortar is able, when applied by spraying, to penetrate the mesh to a small degree thereby causing the mesh to become well embedded in the mortar and result in an effective stopping.

In a preferred embodiment of the invention employing a steel mesh, a fire resistant stopping can be prepared by spraying the mortar from one side only.

According to the present invention a method for installing a stopping in a mine opening comprises the steps of: (a) securely fixing in the mine opening a screen mesh having a size of about 2 to 24 mesh [preferably about 10 to 20 mesh, most preferably about 12 to 16 mesh], (b) applying a ready-to-use mortar to the screen to form a coating on the screen; and (c) continuing the application of the mortar until the stopping is airtight.

To achieve an airtight coating the thickness of coating will usually be at least about 1/32 of an inch (0.08 cms) and may conveniently be at least 1/16 of an inch (0.16 cms). The thickness of the mortar coating is conveniently between about 1/4 to 2 inches (and preferably substantially uniform in thickness) although thicknesses greater than this may be used.

The Screen.

The screen is intended to support the mortar while it sets and thereafter. The screen can be in the form of a mesh. The mesh may be in the form of a perforated sheet e.g. a metal sheet with holes punched through or in the form of an expanded metal. However a woven mesh (particularly one made of steel wire) is preferred because of its ease of attachment to the mine walls and floor and because it can be supplied in rolled up form as a cylinder. Desirably the screen has a tensile strength of at least about 150 lbs/inch$^2$ preferably at least about 200 lbs/inch$^2$, and most preferably at least about 250 lbs/inch$^2$.

The mesh may be made of a plastics material such as a polyolefin plastics material, e.g. polypropylene, polyester or polyamide. Alternatively the mesh can be made of glass fiber or metal, such as steel.

Preferably the screen is of sufficient gauge of mesh that when a screen measuring about 8 feet by 4 feet is fixed in the mine opening with attachment points spaced at intervals of about 12 inches it can withstand a pressure of at least 39 pounds per square foot according to the test laid down in ASTM E72 before the mortar is applied The Mortar.

The mortar is preferably a ready-to-use mortar and can conveniently be non-hydraulic, i.e. one that sets by drying. Preferably the mortar is non-cementitious. Ready-to-use mortars are supplied in sealed containers containing the required amount of water. The mortar may be silicate based, for example, as described in U.S. Pat. No. 5,165,958 (the disclosure of which is incorporated by reference herein) or a cementitious mortar which contains a retarder and a polymer in an amount to provide flexibility and which is mixed with an accelerator at the point of use.

The mortar may be any cementitious mortar mix, shotcrete, gunite, any ready-to-use mortar, or other substance such as a polyester, epoxy or polyurethane mortar setting by means other than hydration, or any mortar that allows the backing to meet the requirements of 30 CFR subpart D sections 75.300 et seq as interpreted by MSHA.

Flexible mortars may be used, for example those containing 3 to 20% by weight, based on the total weight of mortar, of polymer.

The mortar may be a fast-setting mortar and may also be capable of setting under wet or humid conditions. Such mortars are described in U.S. Pat. Nos. 5,165,958 and 5,330,785 (the disclosures of which are incorporated by reference herein).

The mortar is conveniently provided in the form of two components to be mixed. One component may comprise an alkali metal silicate solution and a non-reactive filler and the second component may comprise a solution of a water miscible reactant for the alkali metal silicate.

Preferably the alkali metal silicate is sodium or potassium and preferably the $SiO_2$ to $M_2O$ mole ratio is from 2:1 to about 4:1 where M represents the alkali metal and the silicate solution has a solids content in the range of 10 to 60% by weight, preferably about 30 to 40% by weight (the remainder being water), and most preferably about 36%. Also, potassium silicate, as defined hereinabove, may be used.

The fillers used should, as stated above, be non reactive and compatible with the silicate solution in order to provide a long term shelf life. Suitable fillers are calcium carbonate (e.g. limestone), mica, cellulose fiber, other reinforcing non-reactive fibers, clay, kaolin, pigments, and dispersing agents.

The water miscible or water soluble reactant to initiate gel formation may be any weak acid or acid salt or ester or ester blend that hydrolyses to release acid. Such esters may include diacetin, triacetin, and/or blends of commercially available dibasic esters known as D.B.E. comprising the methyl esters of adipic, glutaric, and succinic acids or other materials of the formula $R_1OOC(CH_2)_nCOOR_2$ wherein $R_1$ and $R_2$ may be the same or different alkyl groups containing from 1 to 20 carbon atoms, preferably 1 to 6 carbon atoms, and n is 2, 3, or 4, together with glycerol or propylene glycol to aid solubility of the ester.

Application of the Mortar.

The mortar may be applied by hand by a suitable mason's tool, such as a trowel. Preferably however the mortar is applied by spraying. A pump may be used for effecting the spraying for example a progressive cavity pump, or a piston pump.

Spraying is conveniently carried out using a spray nozzle under conditions such that the velocity of the material leaving the nozzle is not greater than about 150 feet/second and is typically in the range of about 80 to 115 feet/second. These nozzle velocities, which are achieved by carrying out the spraying operation without compressed air, reduce the tendency of the screen to flex and thereby makes the application easier.

Conveniently the distance of the nozzle from the mesh is from about 2 to 15 feet, preferably from about 3 to 12, and most preferably from about 4 to 10 feet.

Conveniently the spraying is effected using a small size nozzle e.g. one about ⅛ inch in diameter. The nozzle may be in the form of a slit which in use opens to a size equivalent to about ⅛ inch. Preferably no sand or coarse material is used.

It is not, in all cases, essential that the mortar sets, although it is preferred that the mortar does so. In preferred forms of the invention a mortar will be used that will set under the conditions at the installation site.

Although adequate stoppings can be obtained by spraying from one side only, it is within the scope of the present invention to spray both sides if this is desired. When the mesh is made of a combustible material, e.g. polypropylene plastics material, it may be convenient to spray both sides of the screen in order to obtain a fire resistant stopping. It is a feature of the present invention that when the mesh is made of a non flammable material, a fire resistant stopping can be prepared by spraying from one side only.

The screen is securely fixed before mortar application. By "securely fixing" it is meant fixing the screen so that it will act as a support without specifically sagging or bending from the mortar applied to it. The term "mine" as used herein means any underground working. The term "stopping" as used herein means partitions which divide or separate air currents in mines. Stoppings may be used in construction of other ventilation control devices in mines, in particular "overcasts", "undercasts" or "regulators". The term "air-tight" is intended to be given its usual meaning in the mine stopping art. The term "ready-to-use mortar" means a mortar to which it is not necessary to add further water. In some cases it may be necessary to add further material such as hardener and it may be advantageous to add further water but it is not essential to do so.

Mesh measurements as set forth herein are defined as the number of openings/inch from the center of the wires.

A support structure for the screen is preferably secured and tensioned by bolts or similar fastening means fixed to the roof and/or floor and/or side walls (ribs) of the mine. The screen is conveniently installed in the mine opening by fasteners attached to the roof, or floor, or side walls, or friction wedges between structural supports and the roof and/or floor and/or side walls of the mine opening. Preferably, the screen/support structure is attached directly to the roof and rib walls with nails, spads or similar fixing means. Additional strips of rough lumber or similar material may be used to assist in the attachment of the support to the previously attached rough lumber or directly to the walls or roof.

Alternatively there is first attached to the mine walls and/or roof and/or floor, bolting boards made of rough lumber. The support structure which has previously been cut to dimensions somewhat larger than the mine opening is then attached to the wood with nails or spads.

According to another aspect of the invention there is provided a kit of components for installing a stopping in a mine opening the kit comprises as a first component, a screen of mesh size of about 2 to 24 mesh [preferably about 10 to 20], for installation in the mine opening and receiving mortar and supporting said mortar; and, as a second component, a mortar [preferably a ready-to-use mortar] for application to the screen to provide the stopping. The kit may also include other components, such as fasteners. The term "kit" means a pack or container holding the screen and the mortar.

It is desirable to be able to employ a ready-to-use mortar for the preparation of mine stoppings because this enables the operation to be done more quickly, and also because there is a lack of readily available water in many mines. Ready-to-use mortars are supplied in sealed containers and when applied harden by air drying. It has been found according to the invention that there is a problem with ready-to-use mortars in that when they are applied to a mesh to prepare a mine stopping there is a risk of shrinkage cracking. It is a feature of the present invention that by the use of the critical size of mesh described above the problem of shrinkage cracking is avoided. This is particularly significant for a mine stopping where airtightness is required.

BRIEF DESCRIPTION OF THE DRAWINGS

FIGS. 2 and 3 are drawn on a smaller scale than FIG. 1.

DETAILED DESCRIPTION OF THE DRAWINGS

Figure 1:
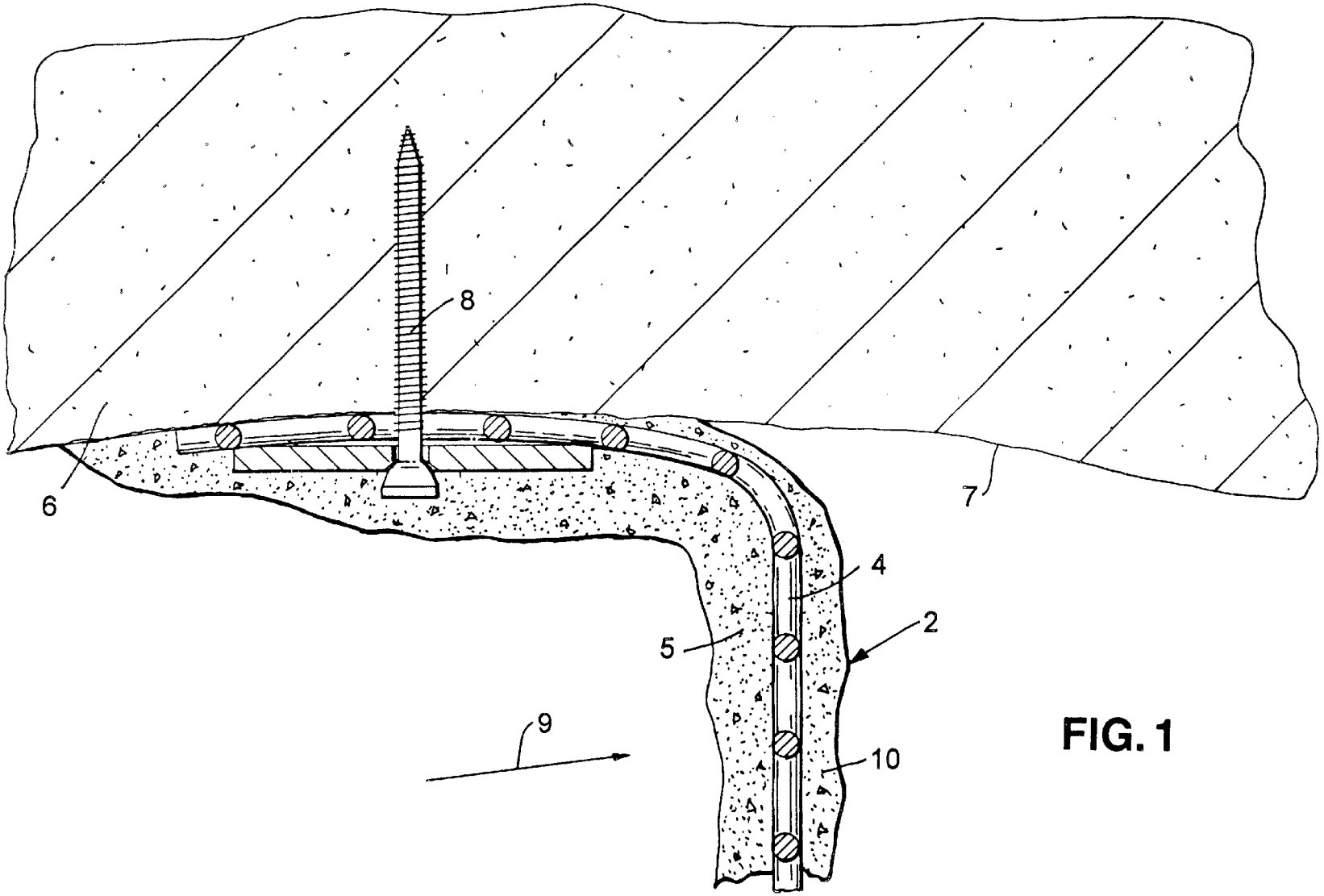
FIG. 1 is a vertical section schematically showing part of a mine stopping according to the invention attached to the roof of a mine opening.
Figure 3:
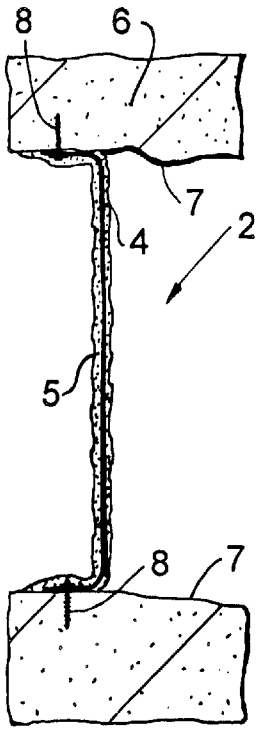
FIG. 3 is a vertical section schematically showing the mine stopping located in an opening of the mine.
Figure 2:
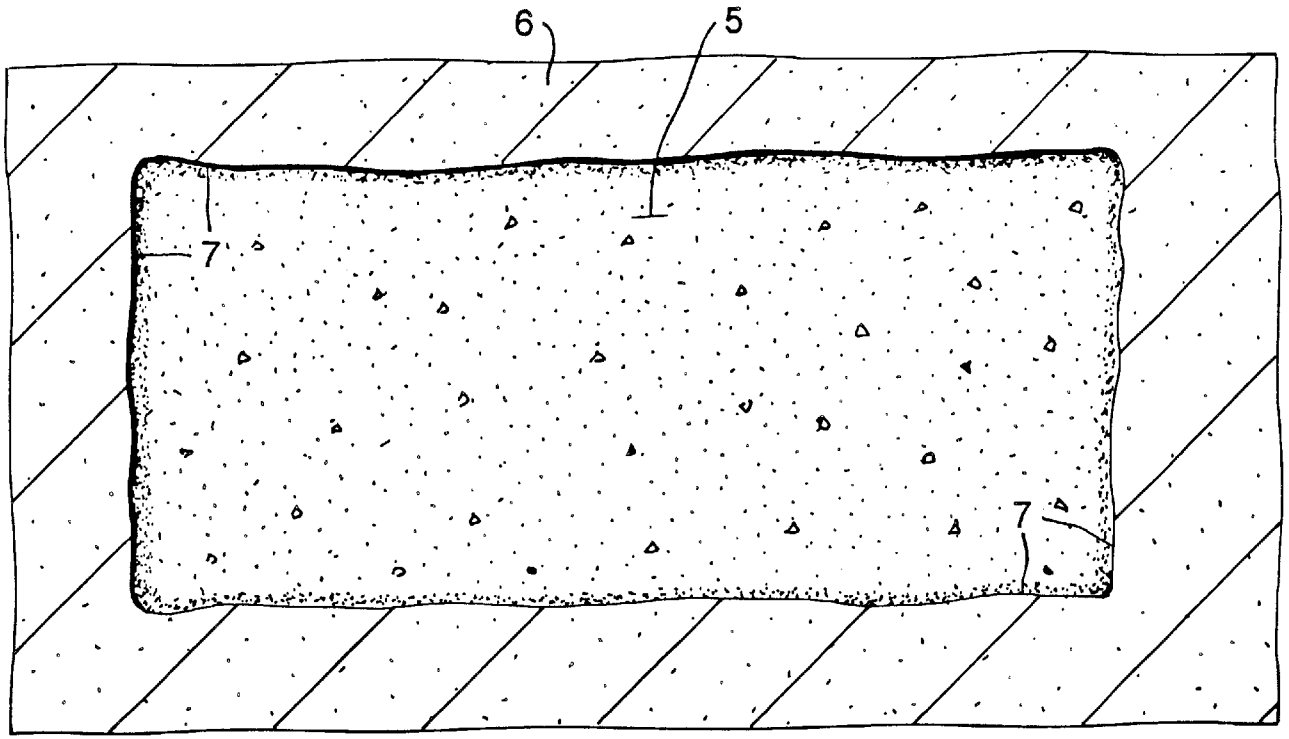
FIG. 2 is a front elevation schematically showing the mine stopping located in an opening of the mine.

Referring to FIG. 1 a stopping indicated generally by numeral 2 comprises a steel mesh 4 onto which has been sprayed a mortar 5. The steel mesh 4 is secured to the roof 6 of the mine opening 7 by ¾ inch self tapping screws spaced at intervals of about 12 inches, only one of which is shown by numeral 8. Similar fasteners hold the mesh 4 around all four sides of the mine opening 7. The mortar 5 has been sprayed from the side indicated by the arrow 9 in FIG. 1 and the mortar that has penetrated the mesh is shown at 10.

The invention may be illustrated by the following Examples.

EXAMPLE 1

Steel Mesh with Ready-to-use Silicate Based Mortar.

A supporting framework to simulate a mine opening [7 ] was made up as follows: a 4 feet by 8 feet wooden frame was constructed upon which was stretched a 4 feet by 8 feet woven steel wire mesh [4 ] of mesh size 14 composed of steel wire of diameter 0.020 inches. This support structure was coated on one side by spraying using AIRTITE 10–19 HC (a silicate based stopping compound available commercially from Fosroc International or Fosroc Inc. of Georgetown, Kentucky) to produce a coating about ½ inch thick. The velocity of the mortar [5 ] leaving the nozzle was in the range of 80 to 115 feet per second, and the distance of the nozzle from the support was about 5 feet. The mortar was allowed to set and dry for several days.

A sufficiently strong stopping [2 ] was obtained by spraying from one side [9 ] only. The mortar [5 ] was found to have penetrated the mesh [4 ] and built up [see 10 ] on the reverse side of the screen resulting in a structure in which the mesh [4 ] was embedded in the mortar [5, 10 ] and provided a robust stopping [2 ]. No shrinkage cracking occurred.

It is a further advantage of the above Example that no backing material is required to prevent the mortar from passing through the apertures of the mesh. The size of the mesh 4 is critical. If the mesh 4 openings are too small there will be insufficient penetration by the mortar 5. If the mesh openings are too large then the mortar will pass through the apertures. The mesh size should be from 12 to 16 with AIRTITE and mortars of similar viscosity and thickness. For less viscous mortars a smaller mesh size may be the optimum and for more viscous mortars a larger mesh size may be the best.

The stopping [2 ] was tested for its ability to withstand convergence as follows: Specimens 12 inches in height and 12 inches in width were placed in a compression test machine and a load applied (to simulate convergence) and were found to be capable of being compressed by 30% without any evidence of cracking or spalling of the coating.

The stopping [2 ] of this Example was tested for fire resistance according to ASTM E119 and successfully passed the test. This is significant in that it shows that a fire resistant stopping can be prepared by spraying from one side [9 ] only.

EXAMPLE 2

Steel Mesh with Cementitious Mortar

A cementitious mortar NITOCOTE CM210 which is available commercially from Fosroc Inc. was mixed with water in the ratio 2248 g powder to 522 g of water. A ¼ inch thick layer [5 ] was hand trowelled onto one side of a 12 inch by 12 inch woven wire mesh [4 ]. The wire was 0.020 inches in diameter and the mesh size was 14. The specimen was left to harden for one week.

No shrinkage cracking was evident. It was tested for its ability to withstand convergence by applying a load in a compression test machine. After a slight (less than 5%) amount of convergence, buckling of the specimen caused it to crack across the middle.

Example 2 was repeated except that the water was replaced by a latex polymer emulsion. 1884 g of NITOCOTE CM210 powder was mixed with 522 g of NITOCOTE CM210 latex polymer liquid. An about ¼ inch layer [5 ] was hand trowelled onto one side of a 12 inch by 12 inch piece of woven wire mesh [4 ] of diameter 0.020 and mesh size 14. The specimen was left to harden for one week. No shrinkage cracking occurred. The specimen was then subjected to the same convergence test as described above. The specimen flexed under load and a degree of convergence of over 30% was noted.

This Example shows that with certain cementitious mortars the flexibility of the mortar and with it the ability to withstand convergence is increased by the incorporation of a polymer.

EXAMPLE 3

Steel Mesh with Ready-to-use Mortar

A structure intended to simulate a mine partition was constructed as follows:

A woven steel mesh [4 ] having a mesh size of 14, the wire being of 0.020 inches in diameter was attached to rectangular wooden framework whose dimensions were 8 feet by 4 feet using lag bolts [8 ] spaced at intervals of about one foot. The assembly of wire and framework was positioned with the longer side of the rectangle (i.e. the 8 feet length) upright and sprayed with a silicate based mortar AIRTITE spraygrade XTC (a product which is commercially available from Fosroc International), together with a hardener. The spraying was carried out from one side [9 ] only. The velocity of mortar leaving the spray nozzle was from 80 to 115 feet per second and the nozzle was about 5 feet from the mesh [4 ]. The spraying was continued until a thickness of mortar [5 ] of about ½ inch had been built up. The structure was then allowed to cure and dry for 10 days. No shrinkage cracking was observed.

The structure was then subjected to a vertical four point bending test as follows: The two 4 feet long ends were held rigidly in a frame so as to simulate attachment to a mine roof and floor. The 8 feet long sides were not attached. A five ton jack was positioned at the center front of the loading frame for application of the load. The load was then applied with the jack and the load increased until a load of at least 39 lb/square foot was exceeded. No evidence of cracking or spalling was observed at this level of loading. The load was increased to 1590 pounds which corresponds to 49.7 lbs/square foot. No failure of the either the material or the fastening system was evident.

A second structure was prepared exactly as described above and tested. A load of 1250 pounds, which corresponds to 39.1 pounds/square foot, was applied. The load was stopped at this level when the material was torn at the two inner spacer locations where the load was applied.

A third structure was prepared exactly as described above and tested as before. A load was applied and increased up to a level of 1770 pounds, which corresponds to 55.3 pounds/square foot. At this load a tear formed at a corner at the 90 degree angle where the mesh was fastened to the wooden end.

The conclusion from the above tests is that the first and third structures easily exceeded the level of 39 pounds/square foot required by the MSHA, which is the regulatory body in the industry in the U.S.A., and the second structure was satisfactory up to this level.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for installing a stopping in a mine opening comprising the steps of:

(a) securely fixing in the mine opening a screen mesh having a size of about 10 to 24 mesh;

(b) applying a mortar to the screen to form a coating on the screen; and (c) continuing the application of the mortar until the stopping is substantially airtight, wherein (d) steps (b) and (c) are practiced by spraying mortar at a velocity of between about 80–115 feet per second into the screen, using a spray nozzle spaced from the screen a distance of between about 2–15 feet, to provide mortar having a thickness of about 1/16–2 inches.

2. A method as claimed in claim 1 wherein step (a) is practiced with a screen of mesh size of about 10 to 20, and (b) and (c) are practiced from only one side of the screen.

3. A method as claimed in claim 2 wherein step (a) is practiced with a screen that is a woven mesh, and having a tensile strength of at least 150 lbs/inch.

4. A method as claimed in claim 2 wherein step (a) is practiced with a mesh made of a polyolefin plastics material, polyester, polyamide, or glass fiber.

5. A method as claimed in claim 1 wherein step (a) is practiced with a screen of mesh size of about 12 to 16.

6. A method as claimed in claim 1 wherein step (a) is practiced with a mesh composed of steel wire of a diameter from about 0.010 to 0.030 inches (0.025 to 0.075 cms).

7. A method as claimed in claim 1 wherein step (a) is practiced by attaching the mesh with fasteners to the roof, or floor, or side walls, of the mine opening, or to friction wedges between structural supports and the roof and/or floor and/or side walls of the mine opening.

8. A method as recited in claim 1 wherein steps (b) and (c) are practiced by manual trowelling from one side of the screen only.

9. A method as recited in claim 1 wherein step (b) is practiced by manual trowelling, and step (c) by spraying.

10. A method as recited in claim 1 wherein (b) and (c) are practiced from only one side of the screen.

11. A kit of components for installing a stopping in an opening in a mine, said kit comprising:

as a first component, a screen in the form of a mesh having a mesh size of about 10 to 24 and having a tensile strength of at least 150 lbs/inch$^2$ suitable for installation in an opening in a mine, and receiving a mortar, and supporting the mortar; and as a second component, a mortar for application to the screen to provide a stopping.

12. A kit as claimed in claim 11 wherein the mortar is capable of setting under humid conditions.

13. A kit as claimed in claim 11 wherein the mortar is in the form of ready-to-use mortar having two components to be mixed, one component comprising an alkali metal silicate solution and a non-reactive filler, and the second component comprising a solution of a water miscible reactant for the alkali metal silicate.

14. A method of installing a stopping in a mine opening comprising the steps of:

(a) securely fixing in the mine opening a screen of woven steel wire mesh having a mesh size of about 10 to 24, and wire diameter of 0.010 to 0.030 inches;

(b) spraying a ready-to-use mortar from a spray nozzle onto the screen; and (c) continuing the spraying until the stopping is airtight.

15. A method as claimed in claim 14 wherein steps (b) and (c) are practiced so that the velocity of the mortar from the spray nozzle is in the range of about 80 to 115 feet per second, and the distance of the nozzle from the screen is from about 3 to 12 feet, and so that the mortar has a thickness of at least 1/32 of an inch.

* * * * *